US005150566A

United States Patent [19]

Stenmans

[11] Patent Number: 5,150,566

[45] Date of Patent: Sep. 29, 1992

[54] THREAD PROCESSING MACHINE SPINDLE ASSEMBLY HAVING MECHANICAL ADJUSTMENT MECHANISMS FOR DEVICES WITHIN A ROTATING THREAD BALLOON

[75] Inventor: Heinz Stenmans, Grefrath, Fed. Rep. of Germany

[73] Assignee: Palitex Project Company GmbH, Fed. Rep. of Germany

[21] Appl. No.: 674,676

[22] Filed: Mar. 25, 1991

[30] Foreign Application Priority Data

Mar. 29, 1990 [DE] Fed. Rep. of Germany ..... 4010017

[51] Int. Cl.[5] ..... D01H 7/90; D01H 1/10; D01H 7/44

[52] U.S. Cl. ..... 57/58.83; 57/58.3; 57/58.38; 57/58.49; 57/113

[58] Field of Search ..... 57/58.3–58.38, 57/58.49, 58.83, 58.86, 78, 90, 113

[56] References Cited

U.S. PATENT DOCUMENTS

| | | | |
|---|---|---|---|
| 2,870,596 | 1/1959 | Vibber | 57/58.3 |
| 3,159,962 | 12/1964 | Franzen | 57/58.83 |
| 3,286,450 | 11/1966 | Vibber | 57/58.36 |
| 3,406,511 | 10/1968 | Nimtz et al. | 57/58.83 |
| 3,410,017 | 11/1968 | Wilson | 43/22 |
| 3,410,071 | 11/1968 | Heimes | 57/58.49 |
| 4,355,500 | 10/1982 | Yanobo et al. | 57/58.86 X |
| 4,605,182 | 8/1986 | Zollinger | 57/58.36 X |

FOREIGN PATENT DOCUMENTS

| | | |
|---|---|---|
| 1510853 | 4/1971 | Fed. Rep. of Germany . |
| 2246174 | 4/1974 | Fed. Rep. of Germany . |
| 2315601 | 7/1974 | Fed. Rep. of Germany . |
| 2628125 | 12/1977 | Fed. Rep. of Germany . |

*Primary Examiner*—Daniel P. Stodola
*Assistant Examiner*—William Stryjewski
*Attorney, Agent, or Firm*—Bell, Seltzer, Park & Gibson

[57] ABSTRACT

In a cabling assembly of a thread processing machine, such as a cabling or double twisting machine having a rotor mechanism and thread storage disk rotating therewith and defining a axially-extending and radially-extending thread passageway defining a first deflection point, a pot mechanism around which a balloon of thread rotates during thread processing, an axially-extending thread guide positioned above the pot mechanism for receiving the thread being processed and defining a second deflection point for changing the direction of thread travel from generally radial to axial during thread processing, and adjustable devices for influencing the mode of operation of the spindle assembly and mounted thereon within the rotating thread balloon formed during thread processing; the improvement of a movable mechanical linkage extending from outside the rotating thread balloon to within the rotating thread balloon and to the spindle assembly operation influencing devices and mounted for movement to adjust such devices. The mechanical linkage includes a hollow sleeve mounted for axial movement in the location of at least one of the thread deflection points and along the axis of the spindle assembly and having at least one lateral aperture for receiving thread to pass axially through the sleeve and radially out of the aperture at the deflection device and for axial movement with the linkage during movement thereof for adjustment of the spindle assembly operation influencing devices.

18 Claims, 4 Drawing Sheets

F3'
F3
37
52
36
38
51
56
50
53
49.1
50.1
50.2
50.3
49
35
47
48
34
f5
46
55
54
B
33.1
44
44.1
57.1
45
33
44.2
f6
43
f1
41
32
31
59
f3
f2
40
39
42
41.2
41.1
f4
57
58

THREAD PROCESSING MACHINE SPINDLE ASSEMBLY HAVING MECHANICAL ADJUSTMENT MECHANISMS FOR DEVICES WITHIN A ROTATING THREAD BALLOON

FIELD OF THE INVENTION

This invention relates to a spindle assembly of a thread processing machine, such as a cabling or double (two-for-one) twisting machine, wherein the spindle assembly includes a driven rotor mechanism having an axially-extending hollow shaft defining a thread passageway, a thread storage disk mounted for rotation with the rotor mechanism and having a radially-extending passageway communicating with the thread passageway of the rotor mechanism to define a first deflection means for changing the direction of thread travel from axial to radial during thread processing, a pot mechanism axially-extending upwardly from the rotor mechanism and around which a balloon of thread rotates during thread processing, axially-extending thread guide means positioned above the pot mechanism for receiving thread being processed and defining a second deflection means for changing the direction of thread travel from generally radial to axial during thread processing, and adjustable means for influencing the mode of operation of the spindle assembly and mounted thereon within the rotating thread balloon formed during thread processing.

BACKGROUND OF THE INVENTION

Such spindle assembly operation influencing means include, for example, thread brakes, twine flyer brakes, twine flyer arrangements or the like. These elements, which are important for the thread course or the mode of operation of the spindle, are, during the orderly spindle run, practically protected from any influence from the outside or at least such an influencing is made difficult. This is disadvantageous, and measures are desired which make it possible to have an influence on such elements, which are provided within the stationary supply bobbin carrier mounted on the spindle, without complex mechanisms being necessary.

It is known to influence the controllable functional elements electrically and/or magnetically as is described for example in German patent publications DE-PS 15 10 853 and DE-PS 15 10 854 (corresponds to U.S. Pat. No. 3,410,017).

Until now, however, in practice no functionally reliable measures are known with which it is possible, during operation of the spindle, to act from the outside on movable control members or other functional elements on or respectively in the supply bobbin carrier.

OBJECT AND SUMMARY OF THE INVENTION

The problem underlying the invention is to provide a device with which it is possible to have an influence from the outside mechanically on functional elements or control members which are arranged in the region of the supply bobbin carrier and during orderly operation of the spindle are encased by the thread balloon hitherto considered as impenetrable.

In order to solve this problem in accordance with the present invention, movable mechanical linkage means are provided which extend from outside the rotating thread balloon to within the rotating thread balloon and to the spindle assembly operation influencing means and are mounted for movement to adjust such means. The mechanical linkage means includes hollow sleeve means mounted for axial movement in the location of at least one of the thread deflection means and coaxial with the hollow shaft and has at least one lateral aperture for receiving thread to pass axially through the sleeve and radially out of the aperture at the deflection means and for axial movement with the linkage means during movement thereof for adjustment of the spindle assembly operation influencing means. Preferably, the sleeve means is mounted inside the hollow shaft of the rotor mechanism and at the first thread deflection means so that the aperture is contiguous to the radially-extending thread passageway of the thread storage disk. The sleeve means also preferably includes means connecting the sleeve means to the hollow shaft in a torsionally-fast manner for rotation with the rotor mechanism.

Further preferred details of this invention as they pertain to spindle assemblies of cabling thread processing machines and/or two-for-one or double twisting thread processing machines will be set forth in the detailed description of preferred embodiments of this invention to follow.

BRIEF DESCRIPTION OF THE DRAWINGS

The invention will be described in more detail herein with reference to the drawings.

DETAILED DESCRIPTION OF PREFERRED EMBODIMENTS OF THE INVENTION

Figure 1:
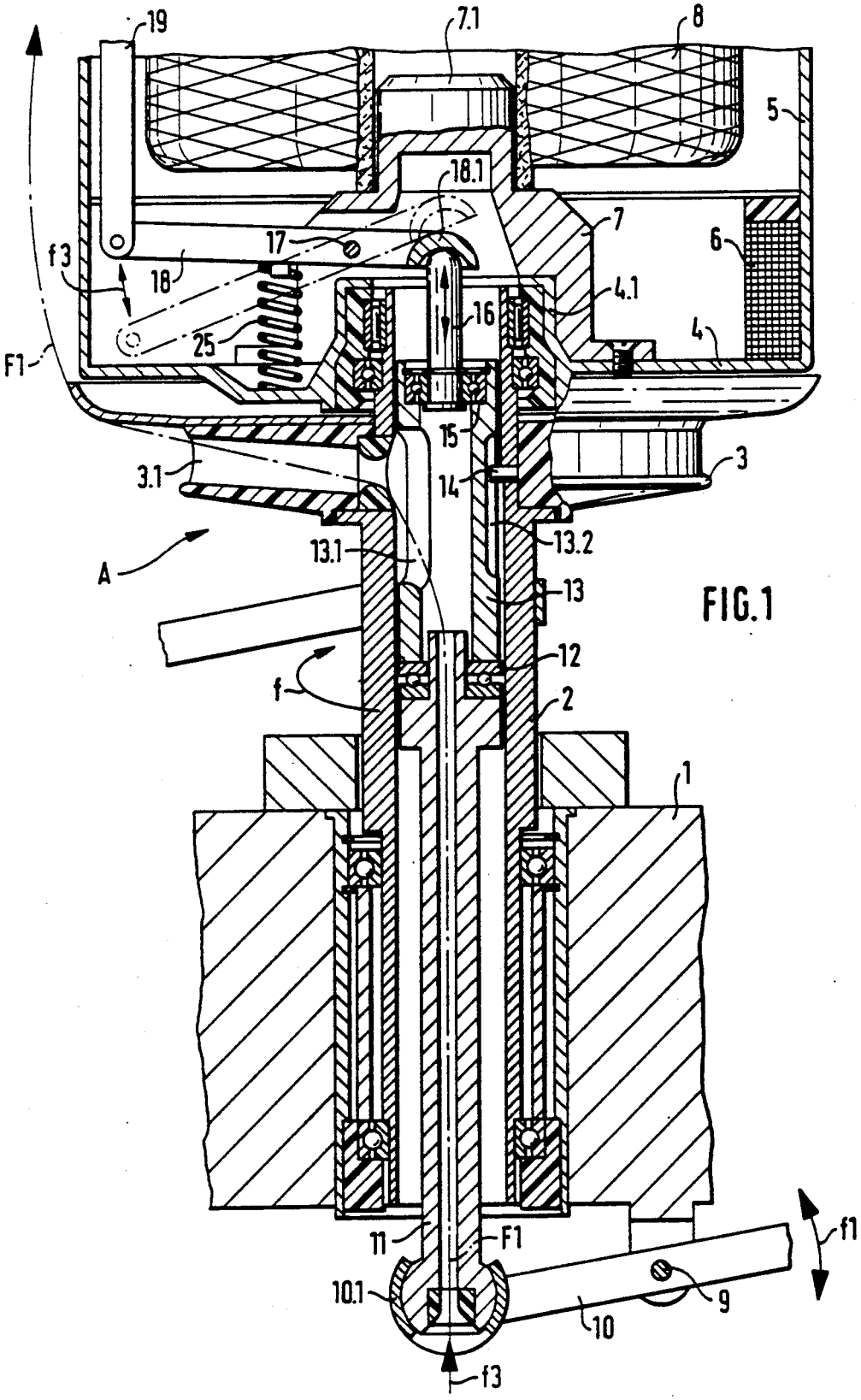
FIG. 1 shows fragmentarily an axial section of the lower part of a cabling spindle assembly.
Figure 2:
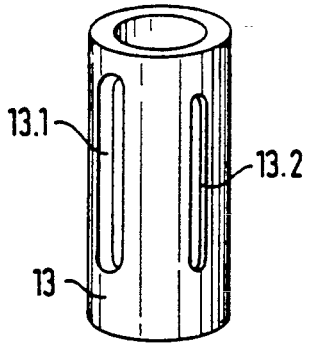
FIG. 2 shows a perspective view of the sliding sleeve used in accordance with the invention.

FIG. 1 shows the solution in accordance with the invention in conjunction with a cabling spindle assembly A. This comprises a driven rotor mechanism including a hollow whorl or respectively hollow shaft 2 which is mounted in a beam 1 so as to be rotatable in the direction of the arrow f and onto the upper end of which a thread storage disc 3 is fixed in a torsionally-fast manner. Mounted on the upper end of the spindle whorl or respectively spindle shaft 2 by means of suitable bearing elements is the protective pot mechanism which consists of the protective pot base 4 and the protective pot jacket 5. The protective pot is secured against rotation for example by means of a permanent magnet 6, which cooperates with a counter-magnet (not shown) arranged outside the spindle. Supported on the protective pot base 4 and a hub 4.1 forming a part of this protective pot base is a bearing block 7 which is concentric with the spindle axis and which carries at its upper end a centering mandrel 7.1 for the centered mounting of a presentation or supply bobbin 8.

Mounted on the underside of the beam 1 is preferably a two-armed lever 10, which is swivellable in the direction of the double arrow f1 about the axis 9 and which carries a mounting support 10.1, lying in the extension of the spindle axis, for a supporting tube 11 projecting from below into the hollow whorl or respectively spindle shaft 2. Supported on the upper end of this supporting tube 11 by means of an axial bearing 12 is a sleeve 13 which is designated as a sliding sleeve and which has in its jacket at least one aperture 13.1, preferably in the form of an axially extending longitudinal slot. This aperture 13.1 is situated in the region of the thread storage disc 3 directly opposite the radially-extending thread guide duct 3.1 of the thread storage disc 3. The sleeve 13 is connected in a torsionally-fast manner to the spindle whorl or respectively spindle shaft 2, e.g. preferably by means of a pin 14 which projects into an axially extending longitudinal groove 13.2 of the sleeve 13 and which is arranged on the inner wall of the spindle whorl or respectively spindle shaft 2.

Inserted into the upper end of the sleeve 13 is a bearing 15 which has a supporting pin 16 which projects by a certain extent beyond the bobbin pot mounting, i.e. the bobbin pot hub 4.1.

Mounted inside the bearing block 6 in accordance with a preferred development is a two-armed lever 18 which is swivellable about a horizontal axis 17. The lever 18 carries at its internal end a ball cup 18.1, with which it is supported on the end, rounded at the top, of the pin 16 affixed coaxially with the spindle axis.

Figure 3:
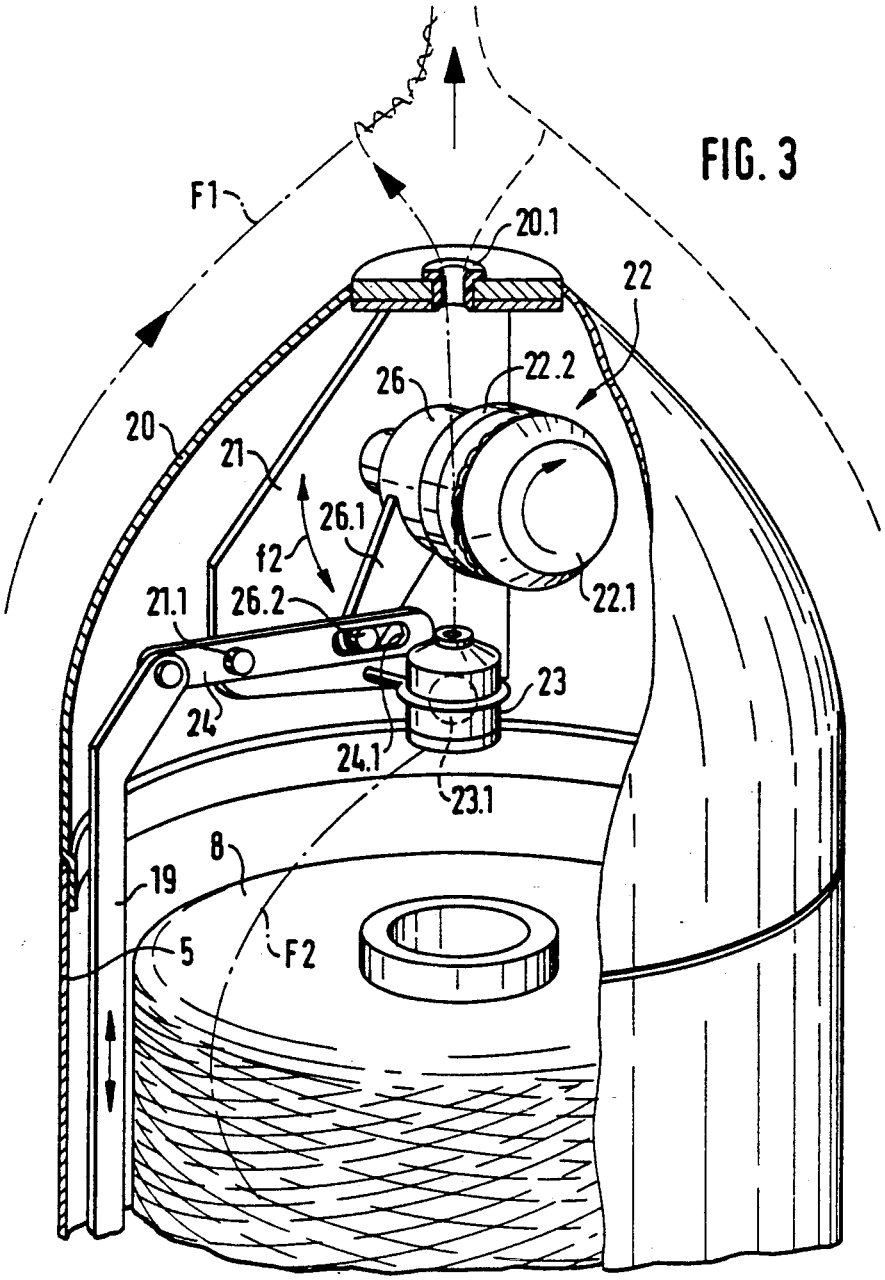
FIG. 3 shows partially in section a side view of the upper part of the cabling spindle assembly of FIG. 1.

Hinged to the outer end, reaching as far as into the gap between the protective pot jacket 5 and the presentation bobbin 8, of the lever 18 is a rod 19 which is conducted upwards in the gap between the protective pot jacket 5 and the presentation bobbin 8, see on this score FIG. 3, in which the upper spindle region is shown.

In accordance with FIG. 3, superimposed onto the protective pot jacket 5 is a hood 20, which has at its upper apex an aperture 20.1 for the thread F2 drawn off upwardly from the presentation bobbin 8. Fastened to the inside of the hood 20 is a mounting support 21 for a thread brake 22, designed in the manner of a lead roller, and a thread guide eyelet 23, arranged in the center of the spindle, for the thread F2. This thread guide eyelet 23 can at the same time contain a thread brake in the form of a ball thread brake, which is represented by the braking ball 23.1 shown in broken lines.

The thread brake 22 is designed in its main part preferably as a hysteresis brake with two disc bodies 22.1 and 22.2 adjustable relative to one another, in such a way that e.g. as a result of a relative displacement of the two disc bodies 22.1 and 22.2 to one another the braking force of the thread brake 22 can be varied.

Associated with the one disc body 22.1 is preferably a ratchet element 26 which is swivellable in the direction of the double arrow f2 and which carries a lever 26.1 with a pin 26.2 affixed thereto. This pin 26.2 engages into a slotted-hole aperture 24.1 at the one end of a double lever 24, which is swivellable about an axis 21.1 situated on the mounting support 21 and is hinged by its other end to the upper end of the rod 19.

In the case of the cabling spindle assembly A which is shown in FIGS. 1 and 3, the one thread F1 is fed in the direction of the arrow f3 centrally from below through the supporting tube 11 and the sleeve 13, through the aperture 13.1 of which it enters into the thread guide duct 3.1. After leaving the thread guide duct 3.1 the thread F1 runs through the thread balloon revolving about the spindle and is united with the thread F2, drawn-off upwardly from the presentation bobbin 8, just below the balloon thread guide eyelet (not shown) in the so-called cording triangle. The threads F1 and F2 united with one another are then further conveyed in the customary manner to a take-up bobbin, not shown, and wound on there.

With the construction in accordance with the invention the possibility exists, during the running operation of the spindle, for the adjustment of the braking force exerted on the thread, of acting mechanically from the outside on the thread brake 22 over which the thread F2 runs. To vary the braking force of the thread brake 22, by a single or repeated swivelling of the double lever 10 in the direction of the double arrow f1 by way of the supporting tube 11 and the sleeve 13, displaceable in the axial direction inside the hollow spindle shaft or respectively spindle whorl, the supporting pin 16 of the double lever 18 is in each case raised, on whose lever end remote from the ball cup 18.1 a restoring spring 25 acts. The double lever 18 thereby swivels in the direction of the double arrow f3. In this way, by way of the rod 19 hinged to the double lever 18 the double lever 24 is swivelled about its swivel axis 21.2, whereby in turn by way of the one-armed swivel lever 26.1 the ratchet element 26 is actuated for the adjustment of the disc body 22.2 of the disc brake 22 relative to the disc body 22.1. As a result of single or repeated swivelling of the ratchet element 26 the one disc body 22.2 can respectively be adjusted in a segment-like manner.

Between the rod 19 striving upwards in the bobbin pot and the double lever 24 the connection is designed as a snap closure, in order to simplify the removal of the hood 20 from the bobbin pot jacket for the extraction of an empty presentation bobbin and the insertion of a new presentation bobbin. The connection point between the rod 19 and the double lever 24 can also be designed as a point of rotation, about which the entire hood 20 including the mounting support 21 and the elements fastened thereto can be swivelled.

It is important that the axial size of the aperture 13.1 of the sliding sleeve 13 is so coordinated to the height of the end lying inside of the thread guide duct 3.1 that during the axial displacement of the sliding sleeve 13 at least a part of the aperture 13.1 is in alignment with the thread guide duct 3.1.

Figure 3A:
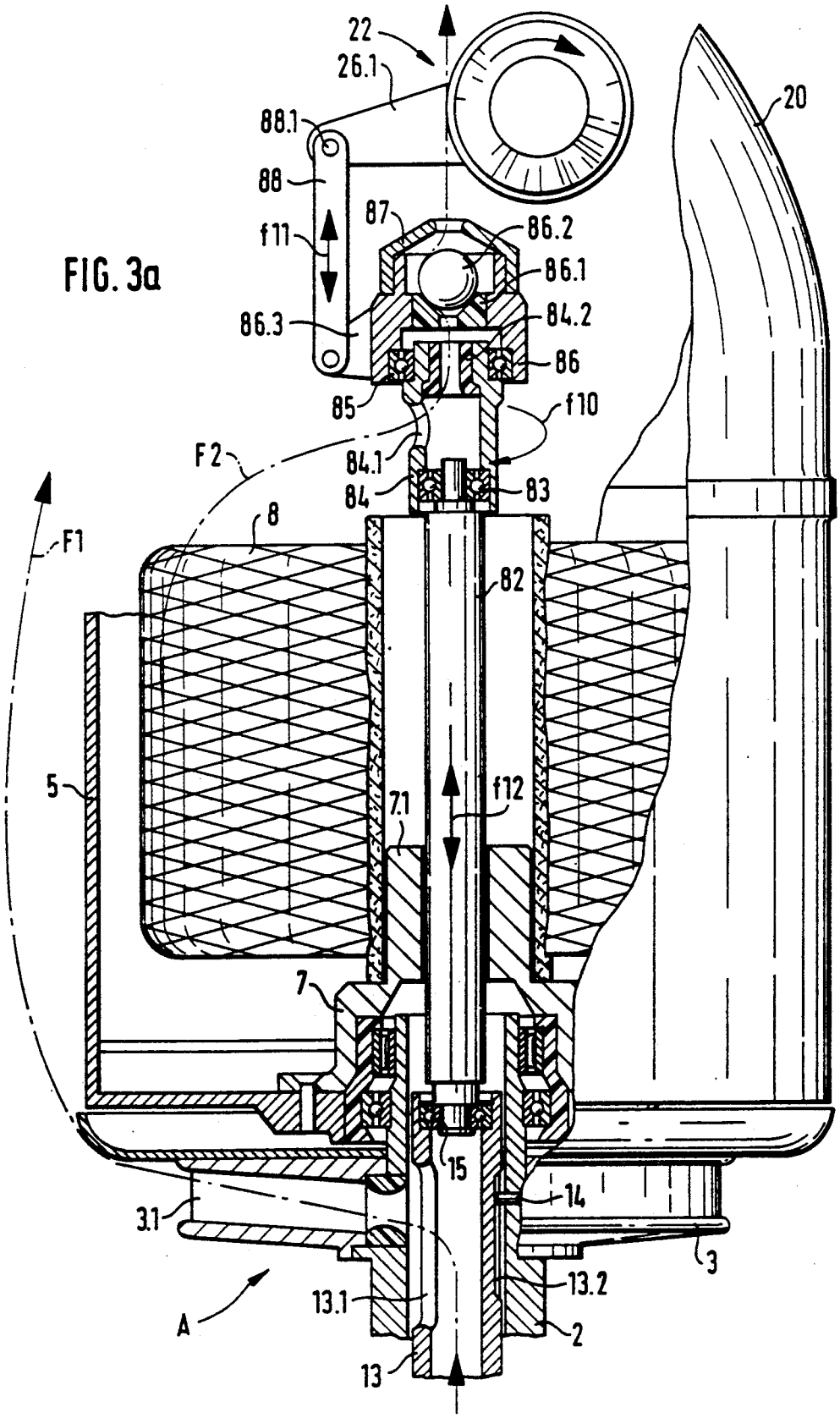
FIG. 3*a* shows a modified embodiment of a cabling spindle assembly, in which respect for constructional elements which correspond with the embodiment in accordance with FIGS. 1 to 3 the same reference numbers have been used as in FIGS. 1 to 3.

In the case of the embodiment in accordance with FIG. 3*a*, the bearing 15 inserted into the upper end of the sleeve 13 serves for the mounting of a shaft 82 extending along the spindle axis. The shaft 82 is conducted through the centering mandrel 7.1 having a central aperture and extends approximately as far as the upper edge of the protective pot jacket 5.

Mounted on the upper end of the shaft 82 by means of a bearing 83 is a sleeve 84 which forms a thread guide eyelet and which has in its jacket at least one aperture 84.1 preferably in the form of an axially extending elongate slot. Inserted into the upper end of the sleeve 84 is a ring body 84.2 made of abrasion-resistant material.

Mounted on the upper side of the sleeve 84 by means of a bearing 85 is a ball thread brake. This ball thread brake comprises a cylinder body 86, into which a braking surface ring 86.1 is inserted, on which a braking ball 86.2 rests. Superimposed, preferably screwed, onto the upper end of the cylinder body 86 is a cap 87 Which has a central aperture.

Affixed to the outside of the cylinder body 86 is a mounting support 86.3. Hinged to this mounting support 86.3 is the one end of a rod 88, the other end of which is hinged by means of the axis 88.1 to the single lever 26.1 of the thread break 22. This thread brake 22 with the single lever 26.1 corresponds to the thread brake 22 as described with reference to FIG. 3.

The thread course of the two threads F1 and F2 corresponds substantially to the thread course in accordance with the embodiment of FIG. 3 with the modification that the thread F2 drawn-off from the presentation bobbin enters laterally through the aperture 84.1 into the sleeve 84, which is in this respect set rotating by the thread F2 in the direction of the arrow f10. The further path of the thread F2 then corresponds to the course of the thread F2 in accordance with the embodiment of FIG. 3, in which respect the thread F2 runs through the thread brake which is formed by the braking surface ring 86.1 and the braking ball 86.2.

Also in the case of the construction in accordance with FIG. 3*a* the possibility exists, during the continuous operation of the spindle, for the adjustment of the braking force exerted on the thread, of acting mechanically from the outside of the thread brake 22 over which the thread F2 runs. To vary the braking force of the thread brake 22, by single or repeated moving away of the lower sleeve 13 by way of the shaft 82, the sleeve 84 and the cylinder body 86, the rod 88 is moved up and down in the direction of the arrow f11, whereby in turn by way of the one-armed swivel lever 26.1 the braking force of the thread brake 22 is varied in the form described with reference to FIG. 3.

Figure 4:
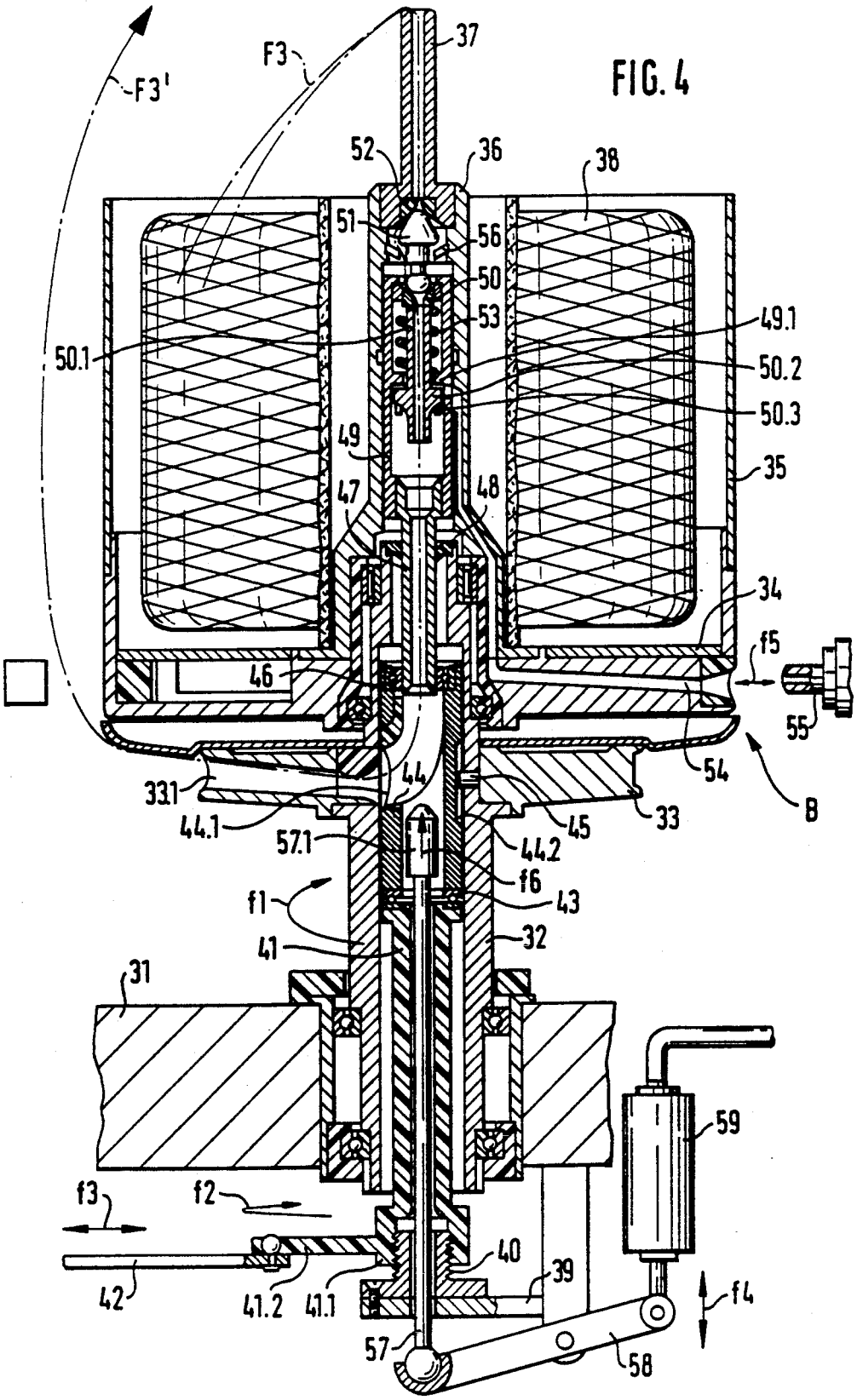
FIG. 4 shows an axial section of a two-for-one twist spindle assembly designed in accordance with the invention.

The two-for-one twisting spindle assembly 8 shown in FIG. 4 comprises in the customary manner a hollow spindle whorl or respectively spindle shaft 32 which is mounted for rotation in the spindle beam 31 and to which the thread storage disc 33 is connected in a rotatable manner and onto which a protective pot, held in a torsionally-fast manner, consisting of protective pot base 34 and protective pot jacket 35, is superimposed.

Superimposed onto the protective pot base 34, coaxially in extension of the spindle hollow shaft or respectively spindle whorl 32, is a hollow shaft 36, into the upper end of which the customary thread entry tube 37 is inserted, into which the thread F3 is drawn-off from the presentation bobbin 38 inserted into the protective pot runs.

Fastened to the underside of the spindle beam 31 is a bracket 39, which carries concentrically with the spindle axis a threaded portion, preferably in the form of a hollow threaded pin 40. Screwed onto this threaded pin 40 is a supporting tube 41 which has at its lower end a threaded portion, preferably in the form of a threaded sleeve 41.1, and on which there acts a swivel lever 41.2 which is swivellable in the direction of the double arrow f2 and on which there acts an actuation element 42 which is adjustable in the direction of the double arrow f3, in order to set the supporting tube 41 and therewith the threaded sleeve 41.1 rotating and thereby to displace same as a function of the thread pitch of the threaded pin 40 or respectively of the threaded sleeve 41.1 in the axial direction along the spindle axis.

Supported on the upper end of the supporting tube 41 by means of an axial bearing 43 is a sleeve 44, which has in its jacket at least one aperture 44.1, preferably in the form of an axially extending elongate slot. This aperture 44.1 is situated in the region of the thread storage disc 33 and lies directly opposite the radially extending thread guide duct 33.1 of the thread storage disc 33. The sleeve 44 is connected in a torsionally-fast manner to the spindle whorl or respectively spindle shaft 32, namely by means of a pin 45 which projects into an axially extending elongate groove 44.2 of the sleeve 44 and which is affixed to the inner wall of the spindle whorl or respectively spindle shaft 2.

Inserted into the upper end of the sleeve or respectively sliding sleeve 44 is a bearing 46, which receives a connection tube 47 which projects by a certain extent beyond the upper end of the spindle shaft 32. Arranged between the upper end of the spindle shaft 32 and the connection tube 47 is a ring lip seal 48. Contiguous to the upper end of the connection tube 47 is a connection tube 49 which extends coaxially with the spindle axis and which has approximately in its central region a ring shoulder 49.1 and inserted into the upper end of which is a lower braking surface ring 50 for a braking capsule 51, the upper end of which butts against an upper braking surface ring 52, which is inserted into the lower end of the thread run-in tube 37.

The lower braking surface ring 50 is supported elastically by a helical compression spring 53, which is for its part supported against the ring shoulder 49.1 of the connection tube 49. Fastened to the underside of the lower braking surface ring 50 is a guide tube 50.1, which is conducted through the aperture formed by the ring shoulder 49.1 and carries underneath the ring shoulder 49.1 a piston 50.2 which is displaceable in the lower part of the connection tube 49. This piston 50.2 is provided on its underside with supporting dogs 50.3, by which the piston 50.2 is supported against the upper side of the connection tube 47 when it is moved downwards contrary to the force of the spring 53.

Into the space between the upper side of the piston 50.2 and the lower side of the supporting shoulder 49.1 there opens out, through a lateral aperture of the connection tube 49, a compressed-air duct 54 which is conducted through the jacket of the spindle hollow shaft 36 and the protective pot base 34 and the outer end of which lies at the outer edge of the protective pot base 34, in such a way that into the compressed-air duct 54 there can be inserted a compressed-air connection 55 which is displaceable in the direction of the double arrow f5.

The lastly described arrangement serves for the pneumatic threading-in of a thread F3 drawn-off from the presentation bobbin 38. When by means of the compressed-air connection 55 compressed air is blown into the space between the piston 50.2 and the ring shoulder 49.1, the piston together with the guide tube 50.1 and the lower braking surface ring 50 is moved downwards contrary to the force of the restoring spring then again supported between the two braking surface rings 50 and 52.

In order, during the orderly thread course, which is represented by the thread balloon F3', to vary mechanically from the outside the braking force, exerted on the running thread, of the thread brake 50, 51, 52, by rotating the supporting tube 41 this is adjusted in the axial direction upwards or downwards, whereby also the sliding sleeve 44 is shifted axially. Since the sliding sleeve is coupled by way of the connection tube 47 and the connection tube 49 directly to the lower braking surface ring 50, whereof the upwardly directed motion is limited by an inwardly projecting ring shoulder of the connection tube 49, as a result of axial displacement of the supporting tube 41 the lower braking surface ring 50 can likewise be displaced, which has a direct influence on the braking force applied by the thread brake 50, 51, 52 and acting on the thread F3. The braking capsule 51 consists for the rest of two parts which engage telescopically into one another and between which a compression spring is supported.

The two-for-one twisting spindle shown in FIG. 4 is equipped with a thread clamping mechanism. This consists of a rod 57 which is conducted through the supporting tube 41 and which carries at its upper end a head piece 57.1, which in the rest state is positioned just below the internal aperture of the thread guide duct 33.1. The lower end of the rod 57 is supported against the one end of a double lever 58, on the second end of which a compression cylinder 59 acts in the direction of the double arrow f4.

When, with the spindle running, by means of a thread sensor, not shown, a thread breakage is ascertained, as a result of an appropriate switching signal of the thread sensor the pressure cylinder 59 is activated, in such a way that under the action of the double lever 58 the rod 57 with its head piece 57.1 is moved upwards against a clamping surface which is formed by the lower end of the connection tube 47, whereby the thread is clamped fast.

In the case of this embodiment of the invention, too, it is important that the axial size of the aperture 44.1 of the sliding sleeve 44 is so coordinated to the height of the internal end of the thread guide duct 33.1 that during the axial displacement of the sliding sleeve 33 at least a part of the aperture 44.1 is in alignment with the thread guide duct 33.1.

What is claimed is:

1. In a spindle assembly of a thread processing machine, of the type comprising a cabling or double twisting machine, wherein said spindle assembly includes top and bottom portions, a driven rotor mechanism having an axially-extending hollow shaft defining a thread passageway, a thread storage disk mounted for rotation with the rotor mechanism and having a radially-extending thread passageway communicating with said thread passageway of said rotor mechanism to define a first deflection means for changing the direction of thread travel from axial to radial during thread processing, a pot mechanism axially-extending upwardly from said rotor mechanism and around which a balloon of thread rotates during thread processing, axially-extending thread guide means positioned above said pot mechanism for receiving thread being processed and defining a second deflection means for changing the direction of thread travel from generally radial to axial during thread processing, and adjustable means for influencing the mode of operation of said spindle assembly and mounted thereon within the rotating thread balloon formed during thread processing; the improvement of:

movable mechanical linkage, extending from outside the rotating thread balloon to within such rotating thread balloon and to said spindle assembly operation influencing means, operating said spindle assembly operating influencing means and including hollow sleeve having an outside surface and upper and lower ends and mounted for axial movement in the vicinity of at least one of said thread deflection means and coaxial with said hollow shaft and having at least one lateral aperture for receiving thread to pass axially through said sleeve and radially out of said aperture at said one deflection means and for axial movement with said linkage during movement thereof for adjustment of said spindle assembly operation influencing means.

2. In a spindle assembly, as set forth in claim 1, wherein said sleeve if mounted inside said hollow shaft of said rotor mechanism and at said first thread deflection means so that said aperture is contiguous to said radially-extending thread passageway of said thread storage disk, and wherein said sleeve includes means connecting said sleeve to said hollow shaft in a torsionally-fast manner for rotation with said rotor mechanism.

3. In a spindle assembly, as set forth in claim 2, wherein said means connecting said sleeve to said hollow shaft in a torsionally-fast manner for rotation with said rotor mechanism comprises a longitudinal groove in the outside surface of said sleeve and a pin fixed to the inside of said hollow shaft and projecting into said longitudinal groove in the axial direction.

4. In a spindle assembly, as set forth in claim 2, wherein said spindle assembly comprises a two-for-one twisting spindle assembly having a hollow spindle axis shaft rotatably mounted on the hollow shaft of said rotor mechanism and being contiguous thereto, an upper thread run-in tube carried by said spindle hollow axis shaft; in which said spindle assembly operation influencing means comprises a thread brake positioned within said hollow spindle axis shaft; and in which said movable mechanical linkage further includes bearing means mounted on the upper end of said sleeve, and tube means having one end connected with said bearing means and extending upwardly therefrom through said spindle axis hollow shaft and operatively connected with said brake means for adjustment thereof upon movement of said mechanical linkage.

5. In a spindle assembly, as set forth in claim 4, wherein said movable mechanical linkage further includes a second hollow tube mounted on said first connection tube means and extending coaxially upwardly therefrom, and in which said brake means has an upper braking surface and a lower braking surface ring inserted into an upper end of said second connection tube means and a braking capsule positioned on said lower braking ring so that the upper end thereof butts against said upper braking surface.

6. In a spindle assembly, as set forth in claim 5, in which said tube includes a ring shoulder means, and in which said brake means further includes helical compression spring resting on said ring shoulder means and abutting said lower braking surface ring.

7. In a spindle assembly, as set forth in claim 1 or 2, in which aperture of said sleeve comprises a slotted hole which extends in the axial direction.

8. In a spindle assembly, as set forth in claim 1 or 2, in which said movable mechanical linkage further includes a supporting tube having upper and lower ends and which extends from below into said hollow shaft of said rotor mechanism and is movable in the axial direction and which includes a bearing on the upper end thereof for rotatably supporting said hollow sleeve.

9. In a spindle assembly, as set forth in claim 8, in which said movable mechanical linkage further includes an actuation element connected to the lower end of said supporting tube for causing the axial movement of said supporting tube and said sleeve.

10. In a spindle assembly, as set forth in claim 9, in which said actuation element comprises a double lever which is pivotally mounted to be swivellable about a horizontal axis.

11. In a spindle assembly, as set forth in claim 10, further including a connecting means for connecting said double lever actuation element to said supporting tube which comprises a ball head on the lower end of said supporting tube and a ball cup on the end of said double lever actuation element for receiving said ball head.

12. In a spindle assembly, as set forth in claim 9, in which said actuation element comprises a threaded portion on the lower end of said supporting tube, a cooperating counter-threaded member mounted stationary at the bottom portion of said spindle assembly and an arm member for rotation of said threaded portion of the lower end of said supporting tube.

13. In a spindle assembly, as set forth in claim 12, in which said actuation element further includes a swivel lever connected to said arm extending from said threaded portion of the lower end of said supporting tube.

14. In a spindle assembly, as set forth in claim 1 or 2, in which said movable mechanical linkage further includes bearing means connected to the upper end of said sleeve means, a pin member mounted on and extending from said bearing, a two-armed lever means pivotally mounted about a horizontal axis on a portion of said pot mechanism and having one end thereof supported on said pin means, and rod means having one end thereof connected to the other end of said two-armed lever and extending upwardly through said protective pot mechanism within the rotating thread balloon formed during thread processing and to said spindle assembly operation influencing means.

15. In a spindle assembly, as set forth in claim 14, in which said spindle assembly further includes a pot mechanism hood means mounted on the upper end of said pot mechanism and having an upper apex, an inside surface a thread passage aperture at its upper apex and a mounting support means mounted on the inside surface thereof and having said thread guide means mounted thereon; in which said spindle assembly operation influencing means comprises a thread brake positioned axially above said thread guide means and mounted on said mounting support means; and in which said mechanical linkage further includes a double lever means pivotally mounted on said mounting support means and having one end thereof connected to the other end of said rod, and a single lever means having one end thereof connected to the other end of said double lever means and having the other end thereof connected to said thread brake for adjustment thereof in response to movement of said mechanical linkage.

16. In a spindle assembly, as set forth in claim 14, in which said mechanical linkage further includes restoring spring means acting on the lever end of said two-armed lever means.

17. In a spindle assembly, as set forth in claim 1 or 2, in which said movable mechanical linkage further includes a bearing means connected to the upper end of said sleeve, and a shaft means connected at one end to said bearing means and extending therefrom axially through said pot mechanism to be operatively connected to said spindle assembly operation influencing means.

18. In a spindle assembly, as set forth in claim 17, in which said spindle assembly further includes a pot mechanism hood means mounted on the upper end of said pot mechanism and having an upper apex, an inside surface, a thread passage aperture at the upper apex thereof and a mounting support means mounted on the inside surface thereof; in which said spindle assembly operation influencing means comprises a thread brake mounted on said mounting support means; and in which said movable mechanical linkage includes a sleeve mounted in the vicinity of said second thread deflection means, a bearing means carried by the upper end of said sleeve, a cylinder body carried by said bearing means and connected to a pivotally mounted rod means which is operatively connected to said brake means for adjustment thereof during movement of said mechanical linkage.

* * * * *